US006267474B1

(12) United States Patent
Mochizuki

(10) Patent No.: US 6,267,474 B1
(45) Date of Patent: Jul. 31, 2001

(54) INK-JET RECORDING DEVICE INK FILLING METHOD AND INK SUPPLY METHOD

(75) Inventor: Seiji Mochizuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/225,359

(22) Filed: Jan. 5, 1999

(30) Foreign Application Priority Data

Jan. 5, 1998 (JP) ..... 10-012101

(51) Int. Cl.[7] ..... B41J 2/175
(52) U.S. Cl. ..... 347/86; 347/85
(58) Field of Search ..... 347/4, 7, 85, 86, 347/87, 404; 346/75; 271/198, 197

(56) References Cited

U.S. PATENT DOCUMENTS

| | | | | |
|---|---|---|---|---|
| 4,207,579 | * | 6/1980 | Gamblin et al. | 346/75 |
| 4,432,005 | * | 2/1984 | Duffield et al. | 347/86 |
| 4,475,116 | * | 10/1984 | Sicking et al. | 347/86 |
| 4,604,633 | * | 8/1986 | Kimura et al. | 347/85 |
| 4,965,596 | * | 10/1990 | Nagoshi et al. | 347/85 |
| 5,831,655 | * | 11/1998 | Asawa et al. | 347/102 |

FOREIGN PATENT DOCUMENTS

| | | | | |
|---|---|---|---|---|
| 32 44 935 | | 6/1984 | (DE) . | |
| 0 714 778 | | 6/1996 | (EP) . | |
| 8023471 | * | 11/1980 | (GB) | 347/7 |
| 2 304 639 | | 3/1997 | (GB) . | |
| 54-151033 | * | 11/1979 | (JP) | B41J/3/04 |
| 9-234886 | | 9/1997 | (JP) | B41J/2/175 |
| 2822586 | | 11/1998 | (JP) . | |
| 95/31335 | | 11/1995 | (WO) | B41J/2/17 |

OTHER PUBLICATIONS

Patent Abstracts of Japan, vol. 009, No. 146 (M–389), Jun. 21, 1985, Abstract of JP 60 024954 A.

Patent Abstracts of Japan, vol. 010, No.021 (M–449), Jan. 28, 1986, Abstract of JP 60 179 258 A.

Patent Abstracts of Japan, vol. 012, No. 179 (M–701), May 26, 1988, Abstract of JP 62 290 544 A.

* cited by examiner

*Primary Examiner*—N. Le
*Assistant Examiner*—Anh T. N. Vo
(74) *Attorney, Agent, or Firm*—Sughrue, Mion, Zinn, Macpeak & Seas, PLLC

(57) ABSTRACT

To provide an ink-jet recording device provided with a subtank having a simple structure independent of the degree of flexibility of an ink reservoir. A subtank comprising a flexible ink bag provided with an ink inlet on one side and an ink outlet on the other side is connected on the passage connecting the ink reservoir and a recording head. As a result, equal performance to a case in which ink is supplied to a recording head with a flexible ink bag with small capacity is achieved.

22 Claims, 6 Drawing Sheets

INK-JET RECORDING DEVICE INK FILLING METHOD AND INK SUPPLY METHOD

BACKGROUND OF THE INVENTION

1. Field of the Invention a

The present invention relates generally to an ink-jet recording device for printing on a large-sized recording medium using an ink-jet recording head, and more specifically to an ink feeder.

2. Description of the Related Art

For an ink-jet recording device which prints in large quantity having a recording head to which ink is supplied from an ink supply source and which is reciprocated in the direction of the width of recording paper to print in the ink-jet recording device, a method of installing the ink supply source in the body and supplying ink to the recording head via a tube is adopted.

If bubbles are included in ink, pressure applied to ink is deteriorated and the performance of jetting an ink droplet is also deteriorated. Therefore, ink is sufficiently degassed in a factory and is housed in an ink cartridge or in an ink bag, and they are packed in a sealed container for shipping.

In an ink-jet recording device which prints on a large-sized recording medium, as a large quantity of ink is consumed in printing, an ink cartridge in which a flexible ink bag in which degassed ink is sealed and an ink end detecting plate based upon which an ink end detector is operated to detect a state near to the shortage of ink or a state in which ink is short are housed in a case and used for ink supply means.

The ink bag is composed of an aluminum laminated film obtained by putting aluminum foil as an intermediate layer between two films, for example an outside nylon film and an inside polyethylene film to function as a barrier to gas and functions as a bag flexibly deformed according to the quantity of ink without losing sealing performance.

However, as sufficient strength is required for a bag and a tank composing an ink reservoir in case when the quantity of ink is increased and the capacity of the bag is remarkably increased, there is a problem that the rigidity of the ink bag is increased, which makes it difficult to smoothly supply ink to a recording head. As a result, the maximum capacity is limited to approximately 500 cc and a frequent supply of ink is required in a large-sized ink-jet recording device.

To solve such a problem, a method of pumping up ink in a subtank, wherein a part of a surface thereof is composed of a flexible film, as disclosed in Japanese published unexamined patent application No. Hei9-234886, for example, and supplying ink to a recording head from the subtank is conceivable. However, there is a problem that the structure of the subtank is complicated.

SUMMARY OF THE INVENTION

The present invention is made in view of these conditions and the object is to provide an ink-jet recording device provided with a subtank which can stably supply ink to a recording head which consumes ink in large quantity without complicating the structure.

A second object of the present invention is to provide an ink filling method suitable for the above ink-jet recording device.

A third object of the present invention is to provide an ink supply method suitable for the above ink-jet recording device.

To achieve such objects, in the present invention, in an ink-jet recording device wherein a recording head for jetting an ink droplet corresponding to a printing signal is mounted on a carriage and ink is supplied from an ink reservoir to the recording head via an ink supply tube, a subtank composed of a flexible ink bag provided with an ink inlet on one side and an ink outlet on the other side is connected on the way of a passage connecting the ink reservoir and the recording head.

As ink in an ink reservoir is poured into a flexible bag and ink is supplied from the flexible bag to a recording head, performance equal to that of a case in which ink is supplied from a flexible ink bag with small capacity to a recording head can be achieved.

DESCRIPTION OF THE PREFERRED EMBODIMENTS

The details of the present invention will be described based upon embodiments below.

Figure 1:
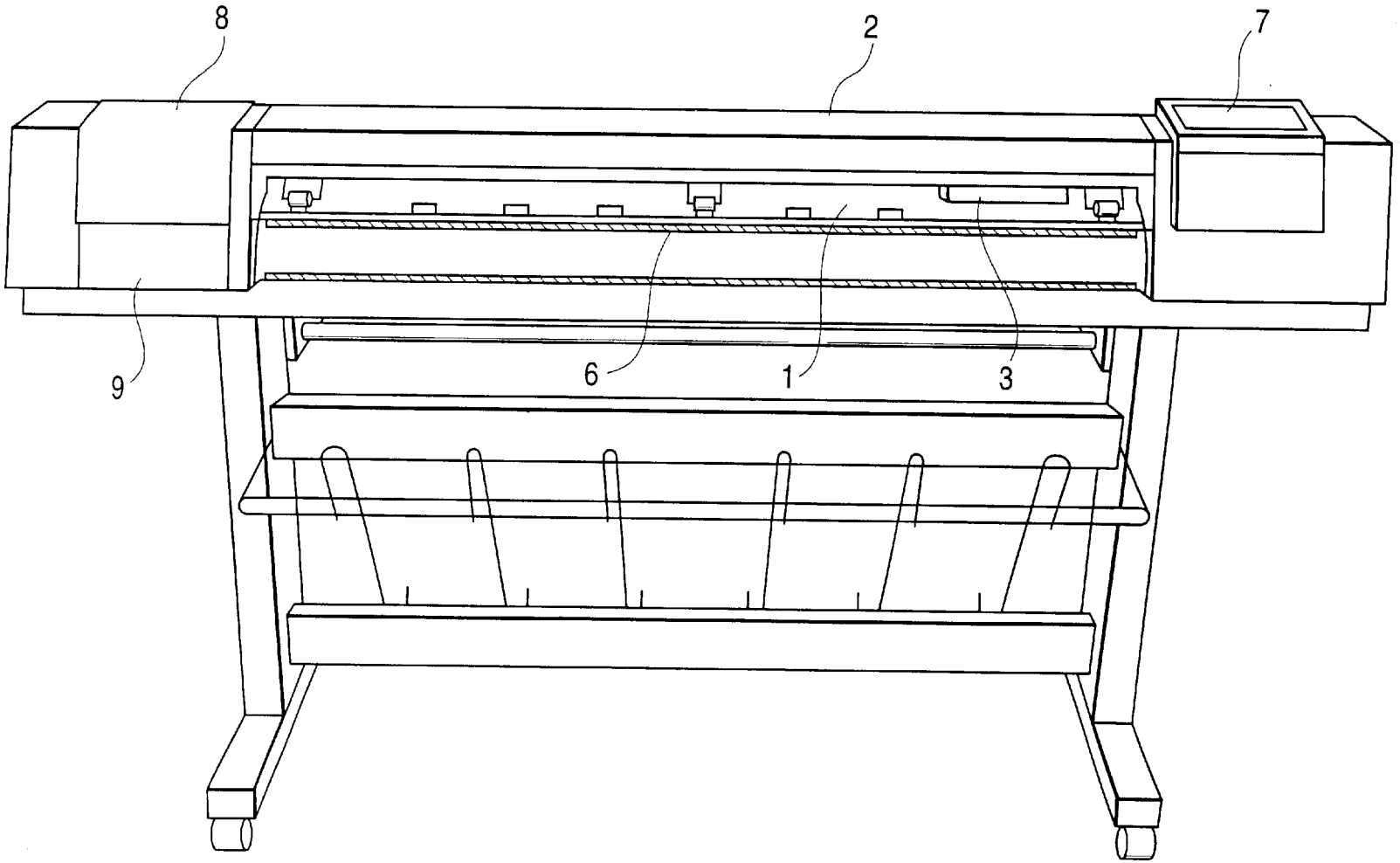
FIG. 1 shows an embodiment of an ink-jet recording device according to the present invention.

FIG. 1 shows an embodiment of the present invention. This embodiment includes a frame 2 including a window 1 with width in which a recording medium as a printing object can pass is provided, ink-jet recording heads 4 and 5 (see FIG. 2) reciprocated in the direction of the width of recording paper on a carriage 3 are provided over the window 1, a paper guide member 6 for supporting recording paper is provided under the window 1, a control panel 7 is provided at the end on the side at a position in which it is easy to operate and an ink tank housing 9 with a cover 8 which can be opened or closed is provided on a side opposite to the control panel 7.

Figure 2:
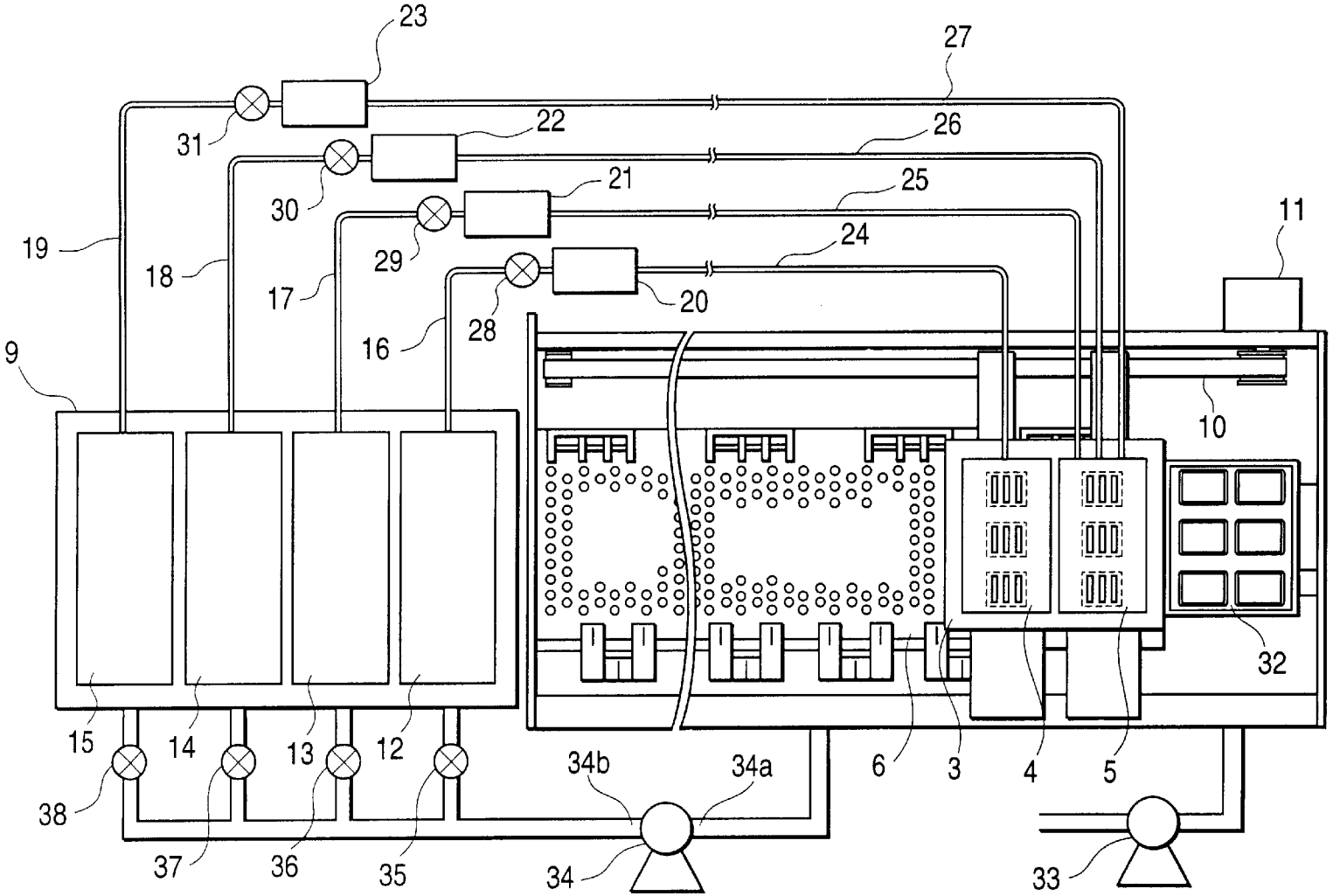
FIG. 2 shows a printing mechanism of the above device.

FIG. 2 shows an embodiment of a printing mechanism of the above device. In this embodiment, the carriage 3 mounts the recording head 4 for jetting black ink and the recording head 5 for jetting an ink droplet in yellow, cyan and magenta and is reciprocated by a carriage driving motor 11 via a timing belt 10 and ink is supplied to the recording heads 4 and 5 mounted on the carriage from an ink supply system described later.

The ink supply system is composed of pressurizing chambers 12, 13, 14 and 15 for respectively housing an ink bag with large capacity, for example, 1 liter, in the ink tank housing 9, subtanks 20, 21, 22 and 23 respectively connected to the ink bag via ink transport tubes 16 to 19 and ink supply tubes 24, 25, 26 and 27 connecting the subtanks 20 to 23 and the recording heads 4 and 5. In this embodiment, electromagnetic stop valves 28, 29, 30 and 31 are respectively connected to the ink transport tubes 16 to 19.

A capping device 32 for applying negative pressure to prevent blocking caused by the drying of ink in the recording heads 4 an 5 during non-printing, when ink is initially filled in the recording heads 4 and 5 and to solve blocking is provided in a non-printing area so that negative pressure can be applied to the recording heads 4 and 5 via the capping device 32 by suction pump 33.

A supporting plate 6*a* on the surface opposite to the recording paper in which thin holes are made is provided on the paper guide 6 so as to apply negative pressure from the suction port 34*a* of a pump 34 to a recording paper and fix the recording paper on the supporting plate 6*a* by negative pressure. The exhaust port 34*b* of the pump 34 is connected to the pressurizing chambers 12 to 15 respectively via the electromagnetic stop valves 35, 36, 37 and 38.

The ink bag as the ink supply means is respectively housed in the pressurizing chambers 12 to 15 and is provided with a connecting port 41 (see FIG. 3) which can be connected to each of the ink transport tubes 16 to 19 on one shorter side 40*a* of the flexible bag 40 which is made, for example, of an aluminum laminated film. The aluminum laminated film may be made by putting aluminum foil as an intermediate layer between two films, for example an outside nylon film and an inside polyethylene film to function as a barrier to gas as shown in FIG. 4. Alternatively, the flexible bag 40 may also be made of a light transmissive film obtained by forming a silicon oxide layer by depositing silicon oxide on the surface a polymeric film having a light transmissive property in addition to good flexibility and sealing performance such as polyethylene telephthalate (PET) and a nylon and laminating a polymeric film such as polyethylene having excellent thermical weld characteristics on the surface.

In this embodiment, a gusset 42 is provided on the longer side of the ink bag 40 to increase the volume as much as possible and the centers of the shorter side 40*b* are welded to prevent the bag 40 from being over-expanded uselessly.

Figure 3:
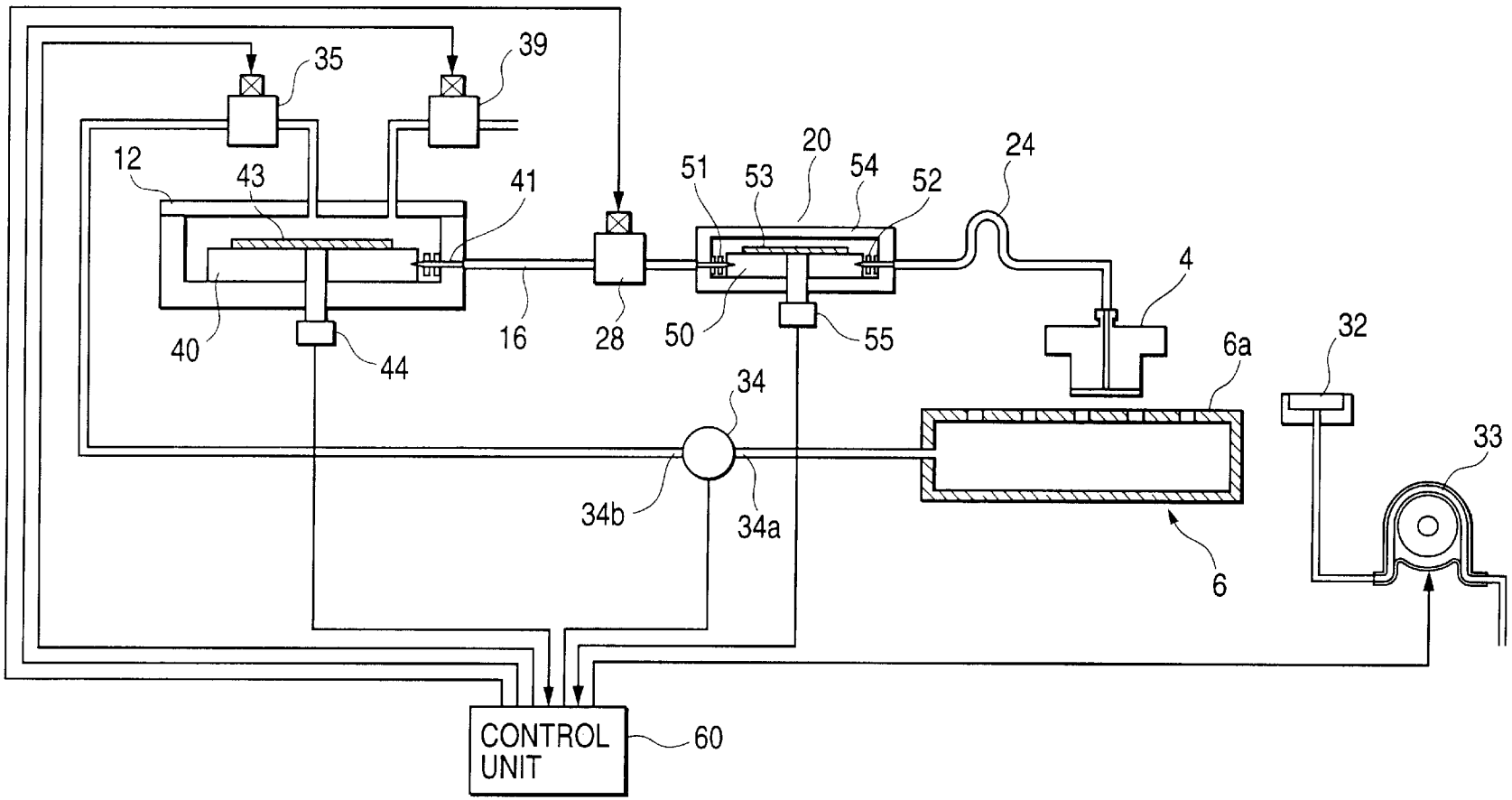
FIG. 3 is a block diagram of a passage showing an embodiment of an ink supply system of the above device.
Figure 4:
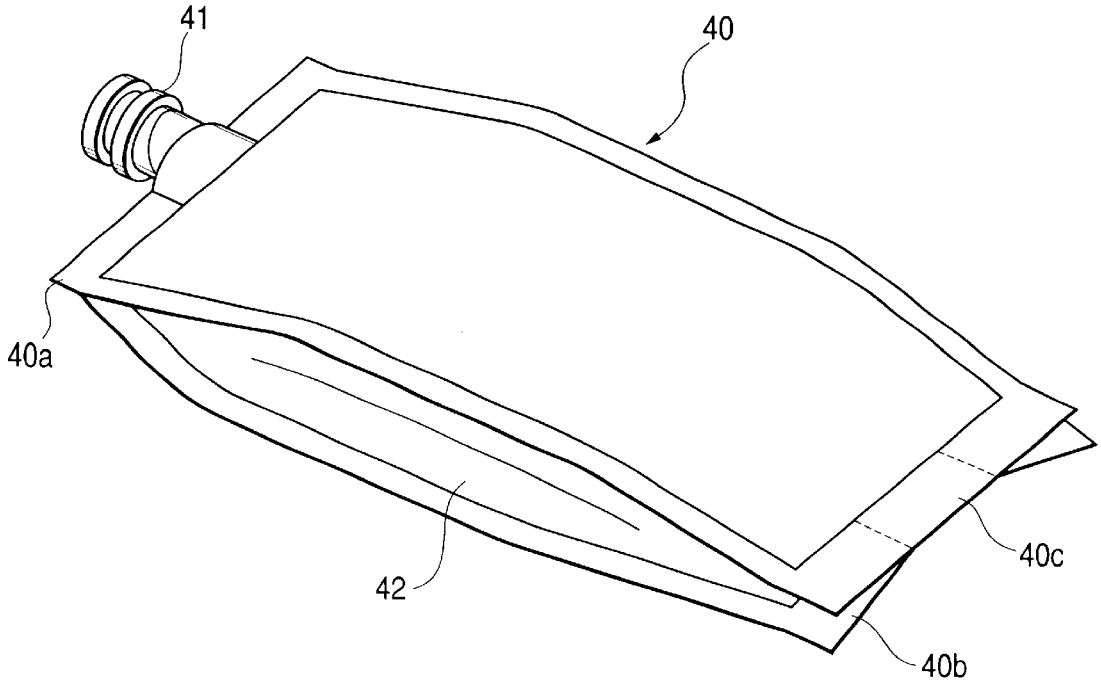
FIG. 4 shows an embodiment of an ink bag used as the ink supply means.

In this embodiment, an ink residual quantity detecting plate 43 attached to the surface of the ink bag 40, as shown in FIG. 3, is housed in the pressurizing chamber 12 and the connecting port 41 is connected to the ink transport tube 16. The pressurizing chamber 12 is connected to atmospheric air via the exhaust port 34*b* and the suction port 34*a* of the pump 34 and the stop valve 39 so that internal pressure can be arbitrarily adjusted.

In this configuration, the ink bag 40 is pressurized by controlling the internal pressure of the pressurizing chamber 12, ink in the ink bag 40 can be discharged into the subtank 20 and the residual quantity of ink can be managed by detecting the degree of the bulge of the ink bag 40 as detected by the ink residual quantity detecting plate 43 and the ink residual quantity detector 44.

Figure 5:
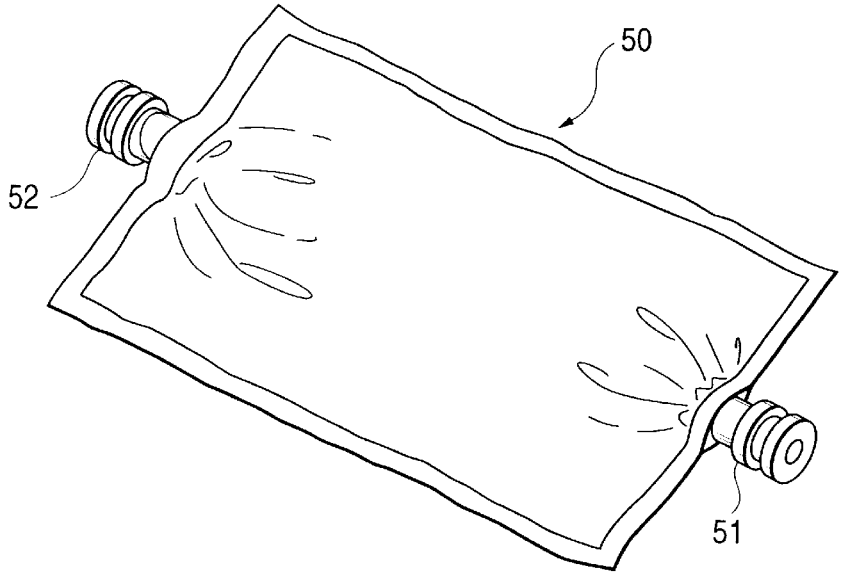
FIG. 5 shows an embodiment of an ink bag constituting a subtank.

A bag 50 is made of an aluminum laminated film obtained by putting aluminum foil as an intermediate layer between two films, for example an outside nylon film and an inside polyethylene film to function as a barrier to gas as shown in FIG. 5, or a light transmissive film obtained by forming, a silicon oxide layer by depositing silicon oxide on the surface a polymeric film having a light transmissive property in addition to good flexibility and sealing performance such as polyethylene telephthalate (PET) and a nylon. A bag 50 is formed of an aluminum laminated film by putting aluminum foil as an intermediate layer between two films, for example, an outside nylon film and an inside polyethylene film. The aluminum laminated film functions as a barrier to gas as shown in FIG. 5. Alternatively, the bag 50 may also be formed of a light transmissive film by forming a silicon oxide layer by depositing silicon oxide on the surface of a polymeric film such as polyethylene having a light transmissive property in addition to good flexibility and sealing performance such as polyethylene telephthalate (PET) and a nylon. The bag 50 is formed in a size in which the shape can flexibly follow the quantity of ink, for example, with a capacity of approximately 100 to 300 cc. An inlet 51 connecting to the ink transport tube 16 and an outlet 52 connecting to the ink supply tube 24 are provided on the opposite sides of the bag 50, thereby to constitute the subtank 20. Thus, the bag 50, inlet 51 and the ink supply tube 24 constitute the subtank 20.

Figure 6:
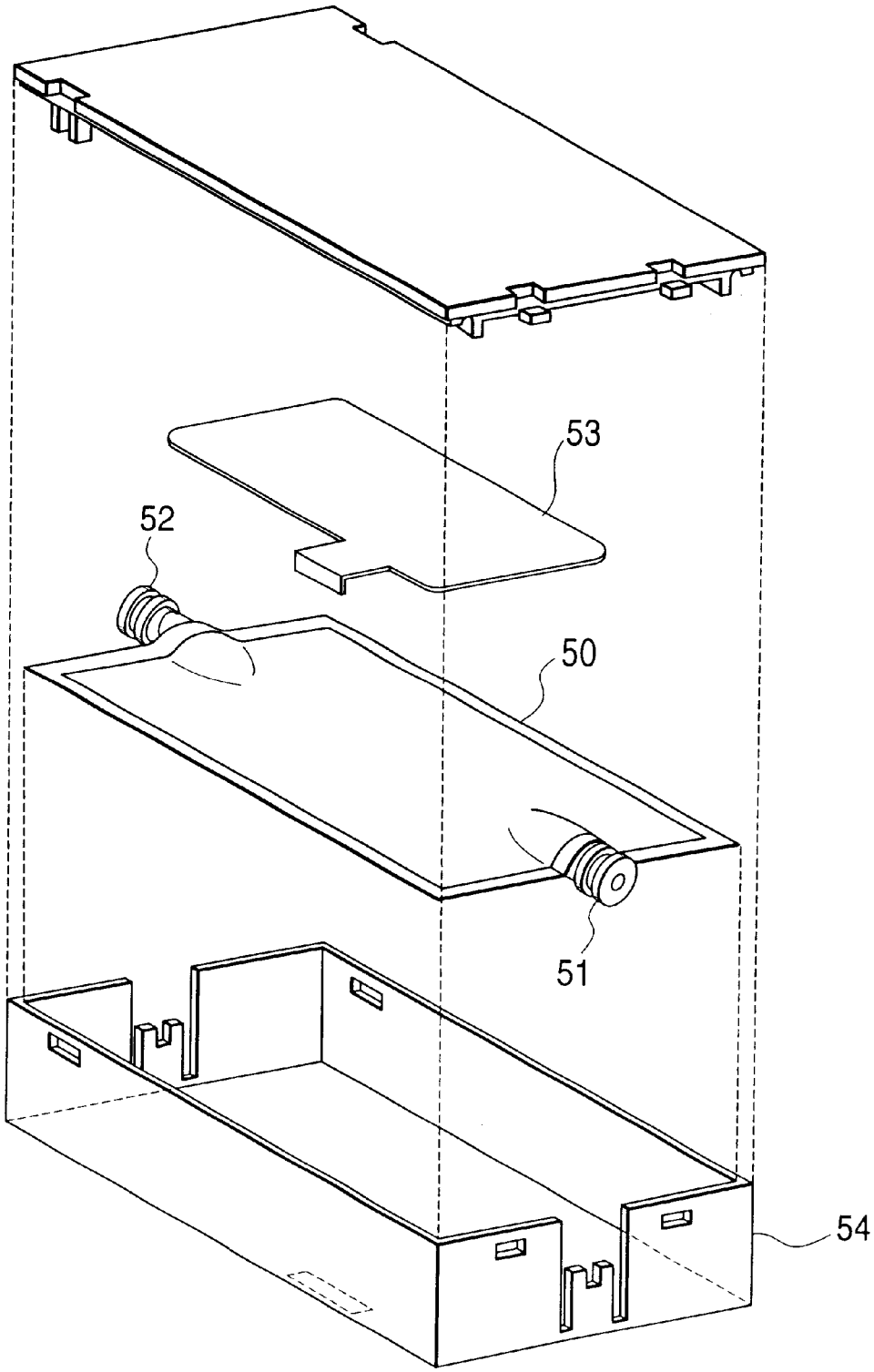
FIG. 6 shows an embodiment if the above subtank is housed in a case.

In this embodiment, an ink quantity detecting plate 53 is attached to the surface of the ink bag 50 as shown in FIG. 6 and is housed in a protective case 54.

By constructing the device as described above, the variation of pressure in the subtank 20 caused by the inflow of ink from the ink bag 40 and the consumption of ink in the recording head 4 is absorbed by expansion and contraction of the flexible bag 50. Accordingly, ink can be supplied to the recording head under fixed pressure. The quantity of ink in the subtank 20 can be managed by detecting the displacement of an ink quantity detecting plate 53 which moves as a function of the degree of the bulge of the ink bag 50 by an ink quantity detecting means 55.

That is, if it is detected by the ink quantity detecting means 55 that the quantity of ink in the subtank decreases to a first provided value or less, a control unit 60 increases the internal pressure of the pressurizing chamber 12 by closing an electromagnetic stop valve 39 and opening the electromagnetic stop valve 35. This causes ink in the ink bag to be supplied to the subtank 20 through the opening electromagnetic stop valve 28. The control unit 60 receives a signal from the ink residual quantity detecting means 44 and the ink quantity detecting means 55 and outputs a driving signal to the electromagnetic stop valves 35 and 39.

When ink is filled up to a second reference value, the supply of ink from the ink bag 40 to the subtank 20 is stopped by closing the electromagnetic stop valves 28 and 35 and opening the electromagnetic stop valve 39. Therefore, the quantity of ink in the subtank 20 is kept in a fixed range.

Particularly, in the case of the subtank 20 which includes the ink bag 50 which is made of a light transmissive film, as inside bubbles can be detected visually, bubbles can be securely removed.

In this embodiment, if ink is initially filled after purchase, first the electromagnetic stop valve 28 and the pump 34 for forcing the recording paper against the paper guide 6 are operated after the ink bag 40 is set, the electromagnetic stop valve 39 of the pressurizing chamber 12 housing the ink bag 40 is closed, the electromagnetic stop valve 35 is opened, hereby, pressure in the pressurizing chamber 12 is increased by air from the exhaust port 34*b* of the pump 34 and the ink bag 40 is contracted.

The recording head 4 is moved to the capping device 32 in a non-printing area and the suction pump 33 is operated with the recording head 4 sealed with the capping device 32. Negative pressure in the capping device 32 is applied to the ink supply tube 24 and the subtank 20 via the recording head 4, air and ink left in these members are discharged into the capping device 32 and when suction is further continued, the subtank 20 is pressed by atmospheric air and is discharged.

Next, when the electromagnetic stop valve 28 is opened, ink in the ink bag 40 flows into the subtank 20 via the ink transport tube 16 and when ink reaches predetermined quantity, it flows into the recording head 4 via the ink supply tube 24. It is desirable to open the electromagnetic stop valve 35 if necessary with the suction pump 33 operating, and to close the electromagnetic stop valve 39 in order to pressurize the ink bag 50.

As described above, as ink is filled in the subtank 20 in a state in which the electromagnetic stop valve 28 is closed and a passage including the subtank 20 is under negative pressure, bubbles in the subtank 20 can be securely removed without requiring a special bubble vent in the subtank 20.

When printing is started after the filling of ink is finished as described above, the recording head 4 jets an ink droplet on the surface of recording paper fixed by negative pressure by the paper guide 6 corresponding to print data, thereby to execute printing and the ink bag 50 supplies ink to the recording head 4 via the ink supply tube 24, contracting as ink is consumed.

When ink in the subtank 20 is consumed by printing and the ink is decreased up to the first reference value, a signal is output from the ink quantity detecting means 55.

The control unit 60 initiates the supply of ink to the subtank 20 by instructing to close the electromagnetic stop valve 39 and to open the electromagnetic valve 35 further to open the electromagnetic stop valve 28, which pressurizes the ink bag 40. In a process in which ink is supplied, ink flows into the subtank at some flow rate. However, as the ink bag 50 disposed in the subtank 20 absorbs the variation of pressure with its own flexibility, ink is supplied under fixed pressure to the recording head 4 without having the effect of the variation of pressure on the recording head 4.

As a signal is output from the ink quantity detecting means 55 when ink is filled up to a second reference value of the subtank 20 as described above, the control unit 60 instructs the supply of ink to be stopped by instructing to close the electromagnetic stop valve 28 to open the electromagnetic stop valve 39 and to close the electromagnetic stop valve 35. Printing is continued, keeping the quantity of ink in the subtank 20 within a fixed range as described above.

In the meantime, if bubbles should invade into the subtank 20 while the ink-jet recording device is operated and the quality of printing is deteriorated, the suction pump 33 is operated by closing the electromagnetic stop valve 28 and sealing the recording head 4 with the capping device 32. Hereby, bubbles which are stagnant in the subtank 20, the ink supply tube 24 and the recording head 4 can be discharged into the capping device 32 without consuming ink in the ink bag 40.

When the electromagnetic stop valve 28 is opened after the suction pump 33 has operated after predetermined time elapses as described above, ink in the ink bag 40 flows into the subtank 20, further flows into the recording head 4 via the ink supply tube 24 and printing is enabled.

If a signal is output from the ink residual quantity detecting means 44 when printing is further continued, and when ink in the ink bag 40 is consumed up and becomes empty, the control unit 60 prompts its user to supply ink via warning means not shown. While the ink bag is being replaced, printing can be continued by using ink stored in the subtank 20, closing the electromagnetic stop valve 28. Therefore, ink can be supplied without interrupting printing.

At this time, even if a small quantity of bubbles invade into the ink transport tube 16, they are caught in the ink bag 50 with relatively large capacity of the buffer tank 20, are prevented from flowing into the recording head 4 and have no bad effect upon printing operation.

Figure 7A:
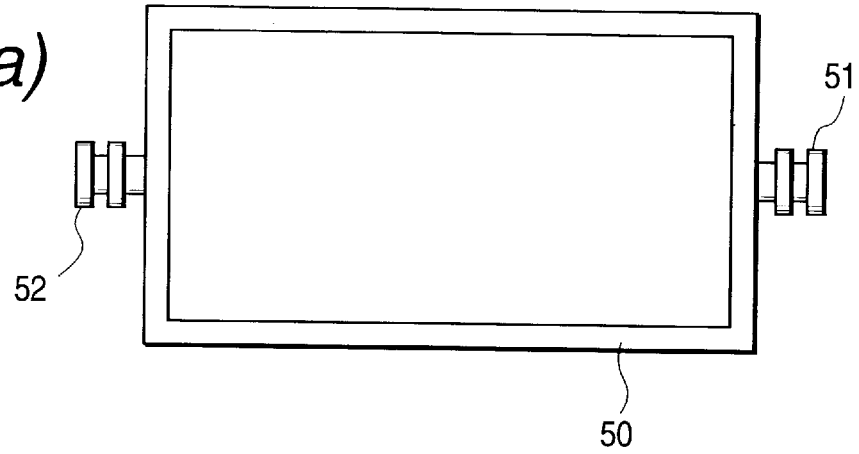
FIGS. 7 (*a*) to 7 (*c*) respectively show another embodiment related to a form in which the ink bag constituting the above subtank is installed.
Figure 7B:
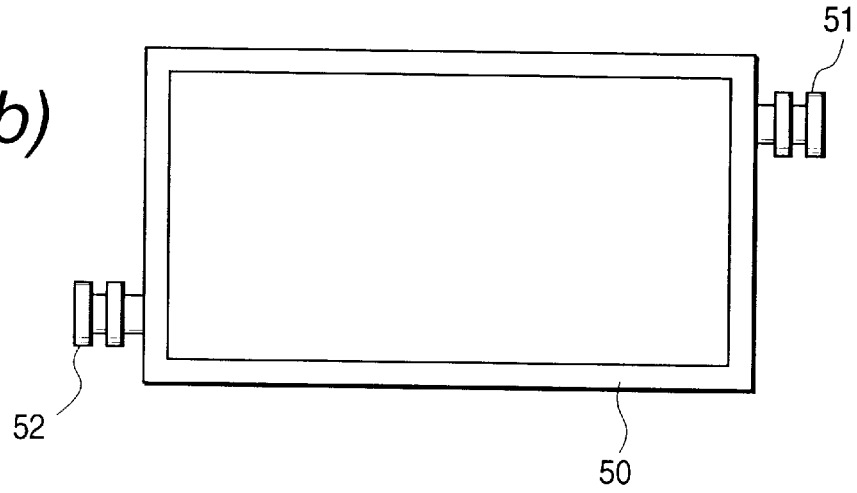
Figure 7C:
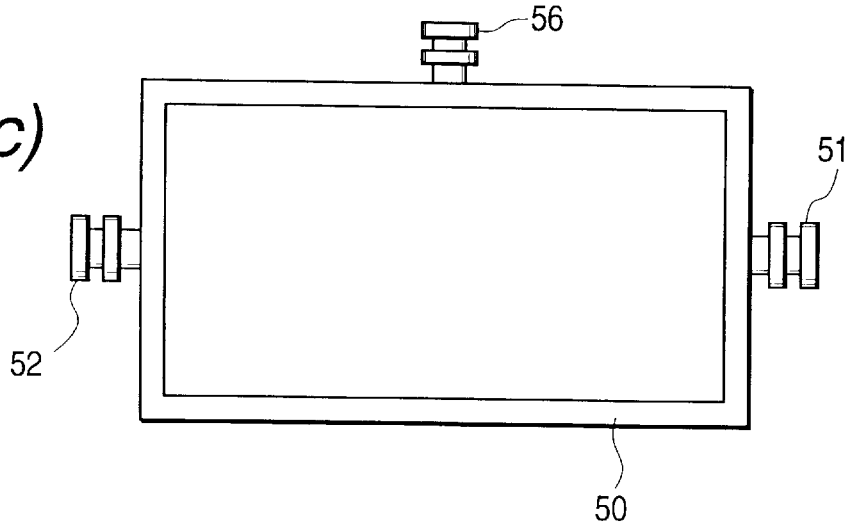

In the above embodiment, the ink bag 50 composing the subtank 20 is installed so that the flat surface is horizontal, however, as shown in FIG. 7 (*a*), the ink bag may be also installed so that the flat surface is vertical. Also, when at least the ink outlet 52 is arranged so that it is below the first reference value as shown in FIG. 7 (*b*), bubbles can be prevented from flowing into the recording head 4. Also, when the ink bag is installed as shown in FIG. 7 (*c*), an air vent 56 is formed in the uppermost part. An electromagnetic stop valve is connected to this and may be also open to atmospheric air when ink is filled.

In the above embodiment, the subtank 20 is installed on the side of the printer, however, it is clear that even if the subtank 20 is installed on the carriage by connecting via a the flexible tube, similar action can be produced.

Also, in the above embodiment, the exhaust pressure of the air pump 34 for attracting recording paper is utilized, however, an independent air pump for pressurizing may be also provided. A pressing plate of a size in which the whole flat surface of the ink bag 50 is covered is provided. The ink bag may be also constituted so that the pressing plate is mechanically displaced.

Further, in the above embodiment, a case in which ink is supplied using the flexible ink bag is described. However, it is clear that even if the above ink bag is applied to an ink-jet recording head in which ink is supplied using a rigid cartridge such as a tank, similar action is produced.

Further, in the above embodiment, the ink residual quantity detecting means such as the ink residual quantity detecting plate 43 is provided to the ink bag 40 to detect the residual quantity of ink, however, if the quantity of ink in the subtank 20 does not exceed the reference value or more even if the ink bag 40 is pressurized for predetermined time when the quantity of ink in the subtank 20 is decreased up to the first reference value or less, ink in the ink bag 40 may be also judged short.

As described above, according to the present invention, in the ink-jet recording device wherein the recording head for jetting an ink droplet corresponding to a printing signal is mounted on the carriage and ink is supplied from the ink reservoir to the recording head via the ink supply tube, as the subtank composed of the flexible ink bag provided with the ink inlet on one side and the ink outlet on the other side is connected on the way of the passage connecting the ink reservoir and the recording head, equal performance to a case in which ink is supplied to a recording head via a flexible ink bag with small capacity can be kept and the degree of the freedom of the body for supplying ink can be enhanced.

What is claimed is:

1. An ink-jet recording device comprising:

a recording head for jetting an ink droplet corresponding to a printing signal mounted on a carriage, wherein ink is supplied from an ink reservoir to said recording head via an ink supply tube;

a subtank disposed between said reservoir and said recording head; and a stop valve disposed between said subtank and said reservoir for continuously supplying ink from said subtank to said recording head while said reservoir is replaced, wherein said subtank comprises a flexible ink bag having an ink inlet and an ink outlet connected to a passage connecting said ink reservoir and said recording head.

2. An ink-jet recording device according to claim 1, wherein a stop valve is provided in said passage connecting said subtank and said ink reservoir.

3. An ink-jet recording device according to claim 1, wherein said ink outlet of said subtank is arranged so that it is lower than a first predetermined reference level.

4. An ink-jet recording device according to claim 1, wherein said subtank is composed of a polymeric film having a layer functioning as a barrier to gas.

5. An ink-jet recording device according to claim 4, wherein said layer functioning as a barrier to gas is made from metal or silicon oxide.

6. An ink-jet recording device according to claim 1, wherein said subtank is provided with means for detecting a residual quantity of the ink therein.

7. An ink-jet recording device according to claim 1, wherein said subtank is arranged on said carriage.

8. An ink-jet recording device according to claim 1, wherein said subtank includes a flat surface, and is arranged so that its flat surface is horizontal.

9. An ink-jet recording device according to claim 1, wherein said subtank includes a flat surface, and is arranged so that its flat surface is vertical.

10. An ink-jet recording device according to claim 1, wherein said ink reservoir comprises a flexible bag and is pressurized.

11. An ink-jet recording device according to claim 10, wherein said flexible bag is pressurized by an air supply means.

12. An ink-jet recording device according to claim 11, further comprising:

a paper guide for supporting a recording medium, wherein negative pressure is applied to said paper guide from a suction pump, and said air supply means is said suction pump.

13. An ink-jet recording device according to claim 10, wherein said pressurizing means is composed of a plate for pressing said ink-reservoir flexible bag by mechanical displacement.

14. An ink-jet recording device according to claim 1, wherein said subtank is provided with an ink residual quantity detecting means, and further wherein a residual quantity of the ink in said subtank is maintained based upon a signal from said ink residual quantity detecting means.

15. An ink filling method of an ink-jet recording device in which a recording head for jetting an ink droplet corresponding to a printing signal is mounted on a carriage, a subtank comprising a flexible ink bag provided with an ink inlet and an ink outlet side connected to a passage connecting an ink reservoir and said recording head and a stop valve connected between said subtank and said ink reservoir, comprising the steps of:

closing said stop valve, applying negative pressure to said recording head and pressing said subtank with atmospheric pressure; and opening said stop valve so that ink flows into said subtank.

16. An ink supply method of an ink-jet recording device in which a recording head for jetting an ink droplet corresponding to a printing signal is mounted on a carriage, a subtank comprising a flexible ink bag provided with an ink inlet and an ink outlet connected to a passage connecting an ink reservoir and said recording head and a stop valve connected between said subtank and said ink reservoir, comprising the steps of:

closing said stop valve and replacing said ink reservoir when a quantity of ink in said ink reservoir decreases below a predetermined level; and continuing to supply ink from said subtank to said recording head while said ink reservoir is being replaced.

17. An ink-jet recording device comprising:

an ink jet recording head for jetting an ink droplets onto a recording medium;

an ink reservoir for supplying to said ink jet recording head;

a subtank connected to said reservoir and said ink jet recording head for supplying ink to said ink jet recording head, wherein said subtank comprises a flexible ink bag; and a stop valve disposed between said subtank and said reservoir for continuously supplying ink from said subtank to said recording head while said reservoir is replaced.

18. The ink jet recording device of claim 17, wherein the flexible ink bag (50) supplies the ink to said ink jet recording head at a fixed pressure.

19. The ink jet recording device of claim 18, further comprising an ink detector (55) which detects a quantity of ink in said subtank.

20. The ink jet recording device of claim 19, wherein said detector comprises a detecting plate (53) which measures displacement of said ink bag.

21. The ink jet recording device of claim 19, further comprising a control unit (60) which causes the ink to be supplied from said ink reservoir to said subtank when a level of ink in said subtank decreases below a first predetermined value and which stops the supply of ink from said ink reservoir to said subtank when a level of the ink in said subtank exceeds a second predetermined value.

22. The ink jet recording device of claim 21, further comprising a valve which closes a connection between said reservoir and said ink jet recording head when the ink in said ink reservoir is being replaced.

* * * * *